United States Patent [19]

Jones et al.

[11] Patent Number: 4,993,368

[45] Date of Patent: Feb. 19, 1991

[54] BOILER TUBE STRUCTURE

[75] Inventors: Harry P. Jones, Emmaus, Pa.; Roger M. Woodward, Brunswick, Me.

[73] Assignee: Armada Investment Group Inc., Broomfield, N.J.

[21] Appl. No.: 536,836

[22] Filed: Jun. 12, 1990

[51] Int. Cl.[5] ..... F22B 15/00; F22B 25/00; F22B 37/20

[52] U.S. Cl. ..... 122/235 K; 122/273; 122/347

[58] Field of Search ..... 122/6 A, 235 R, 235 K, 122/235 A, 235 HH, 253, 255, 273, 325, 347, 138, 149

[56] References Cited

U.S. PATENT DOCUMENTS 3,693,598 9/1972 Cleaver ..... 122/347
4,355,602 10/1982 Cooke ..... 122/235.11

*Primary Examiner*—Edward G. Favors
*Attorney, Agent, or Firm*—Sprung Horn Kramer & Woods

[57] ABSTRACT

A boiler is made up of a housing containing upper and lower manifolds. First and second sets of tubes connect the upper manifold with the lower manifold. One set of tubes joins the upper and lower manifold on the right and the other set joins the upper and lower manifold on the left. The first set rise from the lower manifold in crossing and recrossing pattern. The other set rise from the lower manifold and along the side wall of the housing to the upper manifold.

8 Claims, 19 Drawing Sheets

BOILER TUBE STRUCTURE

The present invention relates to a novel construction of a boiler and similar heat exchangers for heating water while cooling hot gases which are the products of combustion.

Numerous designs exist but it is an object of the present invention to provide one which is simple to construct, assemble and operate, which is highly efficient and capable of handling varying loads, and which is suitable for use on large scale as in large buildings, industrial electric and co-generation plants as well as in relatively small residential installations.

These objects are realized in accordance with the present invention pursuant to which there is provided a boiler comprising a housing having a top provided with a gas outlet, which can be positioned either at the front or rear of the housing to suit individual site conditions, bottom, left and right sides, and a front and back, and within the housing an upper manifold and lower manifold or manifolds substantially parallel to the top, bottom and side walls, two sets of tubes one set of tubes are bent serpentinely so as to form a plurality of superimposed gas passages at least two tubes of this set being bent differently so as to form access openings from each passage to the passages above and below. One set of tubes are straight and are substantially in contact with the bends of the serpentine tubes so they close the lowermost chamber and the gas passages on one side. The gas passages are closed on the serpentine tube side by a removable closing plate. One set of tubes joining the upper left side of the upper manifold to the lower left side of the lower manifold, and the other set of tubes joining the upper right side of the upper manifold to the lower right of the lower manifold. The openings from passage to passage are offset so to require a gas flowing through said passages to traverse one passage from front to back and the next passage from back to front. Means are provided for introducing liquid into the lower manifold and for withdrawing the liquid from the upper manifold, and means for introducing a combustion gas into the lowermost of the superimposed passages. The combustion gases rise successively through the passages which it successively and alternately traverses from front to back and then from back to front until it exits from the uppermost chamber through the gas outlet in the top, liquid flowing through the manifolds and tubes being heated by the combustion gas.

Advantageously the tubes of each set are in substantial contact with one another so as substantially to prevent passage of combustion gas there between. In a preferred embodiment there is provided at least one damper at at least one of the access openings so the furnace pressure can be controlled in conjunction with the amount of products of combustion being produced.

The boiler can be built with the serpentine tubes on the right or left side to reduce space requirements where there are more than one boiler in the boiler room as the straight tube side of the boiler requires only about one third of the clearance of the serpentine tube side for service.

In the simplest form of the boiler the gases in the gas passages above the furnace or lowermost chamber flow from the rear to the front of the boiler and exit at the rear. The boiler can accept a high tech burner with which the radiant products of combustion pass through the furnace or lowermost chamber twice and the gases in the gas passages above the furnace or lowermost chamber flow from the front to the rear of the boiler and exit at the front. This is accomplished by interchanging the differently bent serpentine tubes which form the access openings and allow the gases to flow from one gas passage to the gas passage above. In both configurations the simple addition of an insulating board along the top of the uppermost tubes where the tubes connect to the upper manifold will redirect the gases to either the front or rear of the boiler to exit to the atmosphere through the gas outlet.

For improved heat exchange baffles may be installed within the gas passages to elongate the gaseous flow path. The baffles extend from top to bottom of the passage and from one of the sides toward but terminating short of the other side, whereby the combustion gases transversing that chamber from front to back or back to front is additionally forced to flow laterally to get around said baffles.

The boiler due to the serpentine tubes providing for expansion and contraction of the metal can be brought from a cold condition to full operating temperature in about ten minutes. The boiler can operate with a temperature differential of 150 degrees Fahrenheit between the inlet and outlet. Also the boiler can be cooled rapidly for examination and or repairs without sustaining any permanent structural damage.

The boiler can be easily field assembled without welding in existing buildings through existing doorways, thus eliminating costly general contracting work.

The boiler meets all of the requirements of the American Society of Mechanical Engineers boiler and pressure vessels, sections I and IV, which are recognized by agencies of most governments. The novel boiler incorporates the best features of the fire tube boiler by controlling the passage of hot gases and, by confining the water within small tubes, takes advantage of the best features of the water tube boiler.

All internal parts and surfaces are easily accessible for service and cleaning so the unit is suitable for burning light oil, residual oils, crude oils, waste oils, and type of gas, and any type of coal or solid fuel including municipal waste.

The invention will be further described with reference to the accompanying drawings, wherein.

Figure 1:
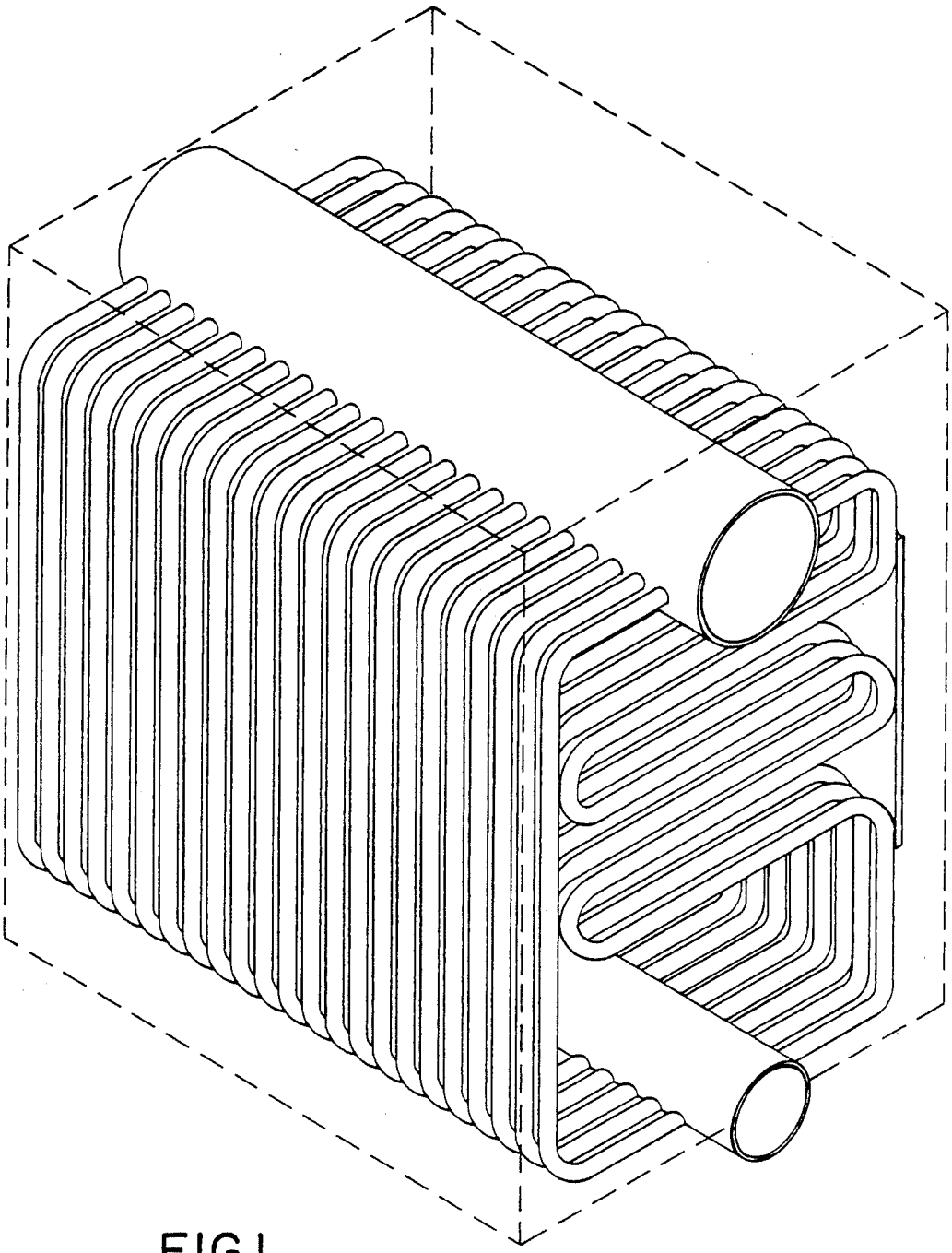
FIG. 1 is a perspective view of a boiler of the invention with the housing shown in phantom. The differently bent tubes that form the access openings are not shown for clarity.
Figure 2:
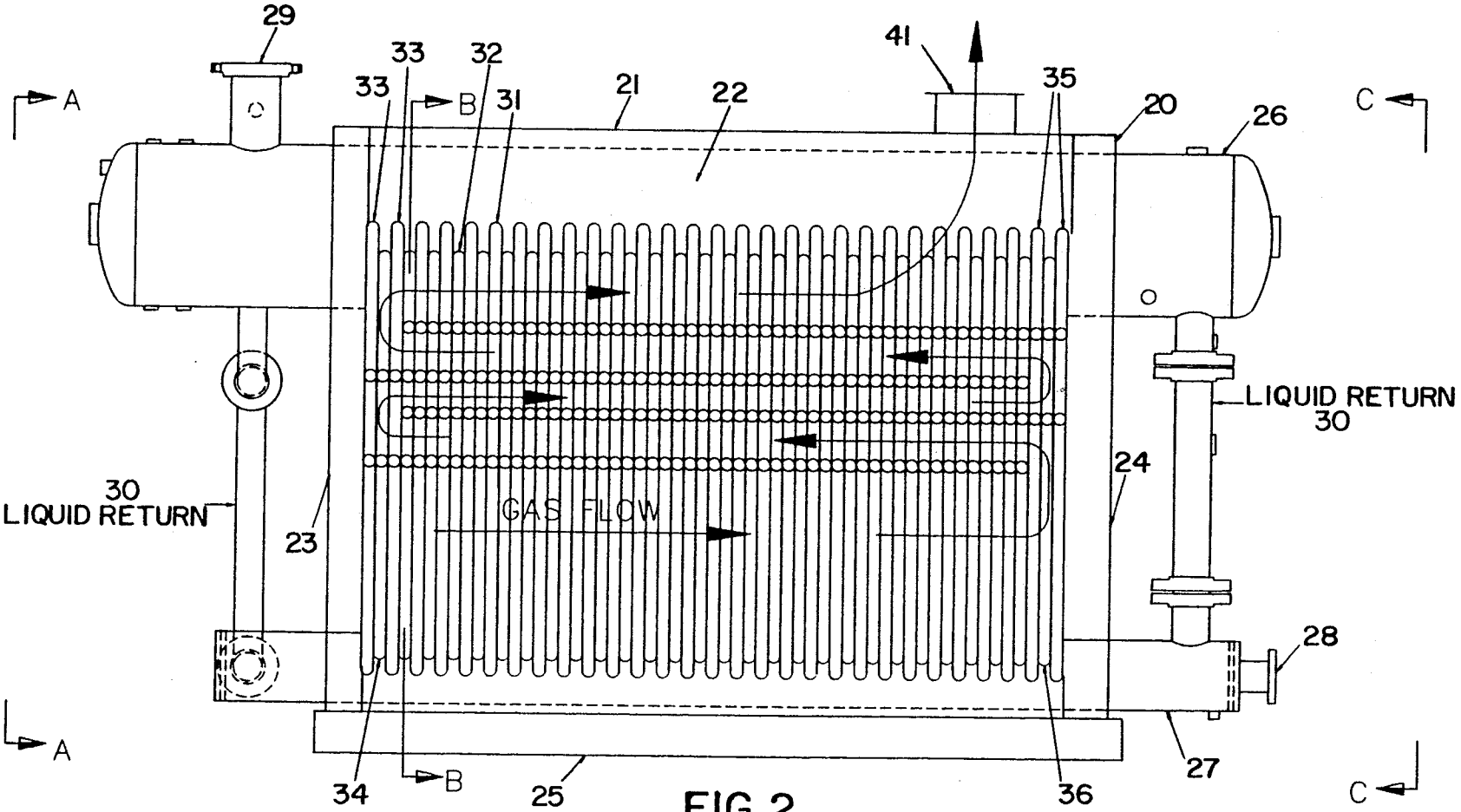
FIG. 2 is a right side view of the boiler and housing with a single gas pass through the furnace or lowermost passage and the gas exit at the rear of the boiler.

Referring more particularly to the drawings, in FIG. 2 there is shown a housing 20 having a top wall 21, two side walls 22, a front wall 23, a rear wall 24, a base 25 and a gas outlet at the rear 41. There are also provided an upper manifold 26, a lower manifold 27, a connection 28 for introducing liquid into the lower manifold, a connection 29 for withdrawing heated liquid or steam from the upper manifold, liquid returns connecting the bottom of the upper manifold to the top of the lower manifold 30; serpentine tubes 31 and 32 which form the gas passages and serpentine tubes 33 and 34 which form the access openings from gas passage to gas passage at the front, and serpentine tubes 35 and 36 which form the access openings from gas passage to gas passage at the rear.

Figure 3:
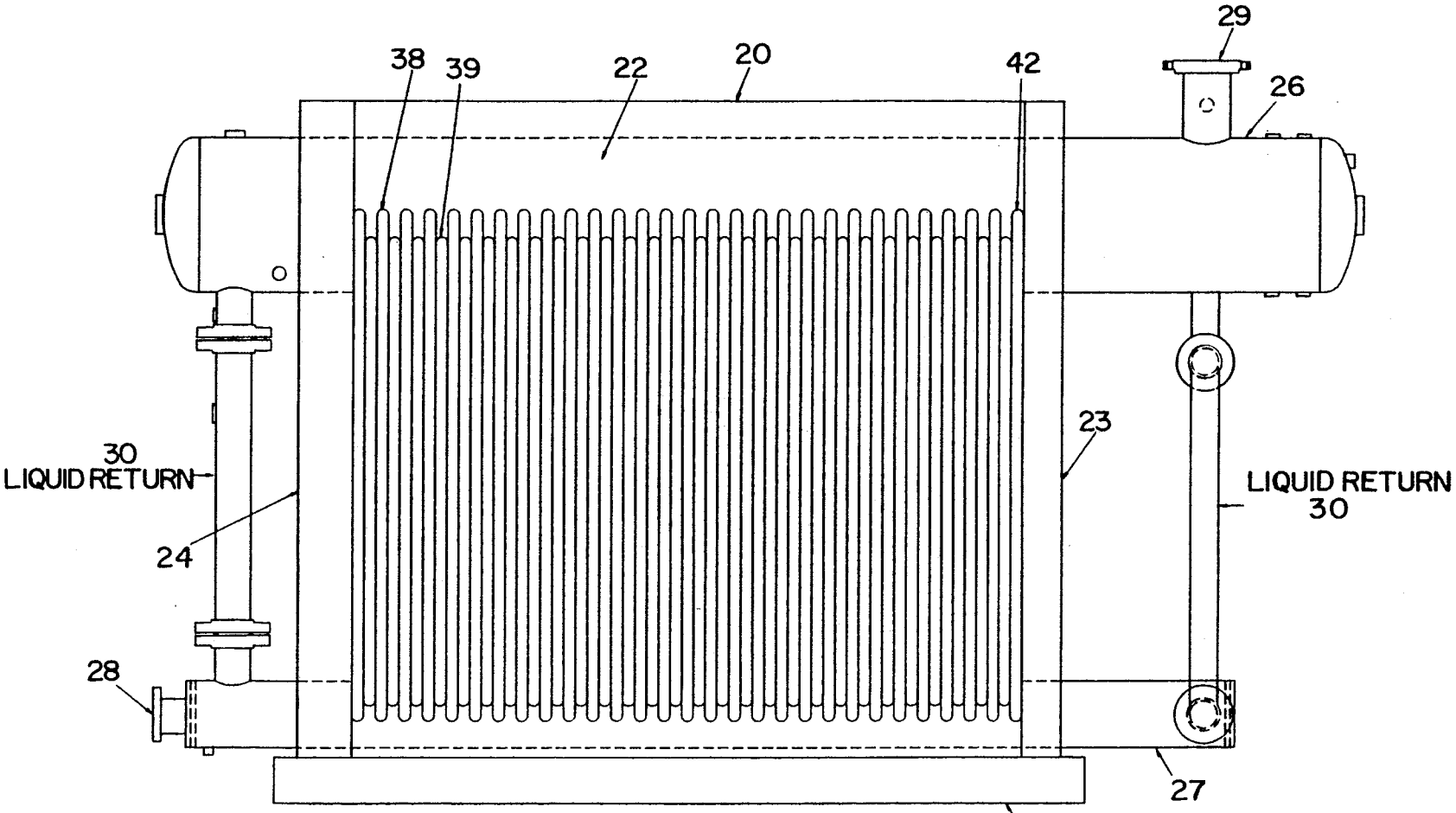
FIG. 3 is a left side view of the boiler in all configurations.

FIG. 3 is a left side view of the boiler and housing which is common to all configurations of the boilers. There is a housing 20 having a top wall 21, two side walls 22, front wall 23, a rear wall 24, a base 25, an upper manifold 28, connection 29 for withdrawing heated liquid or steam from the upper manifold, liquid return 30 connecting the bottom of the upper manifold to the top of the lower manifold, straight tubes 38 and 39, and a vent tube 42.

Figure 4:
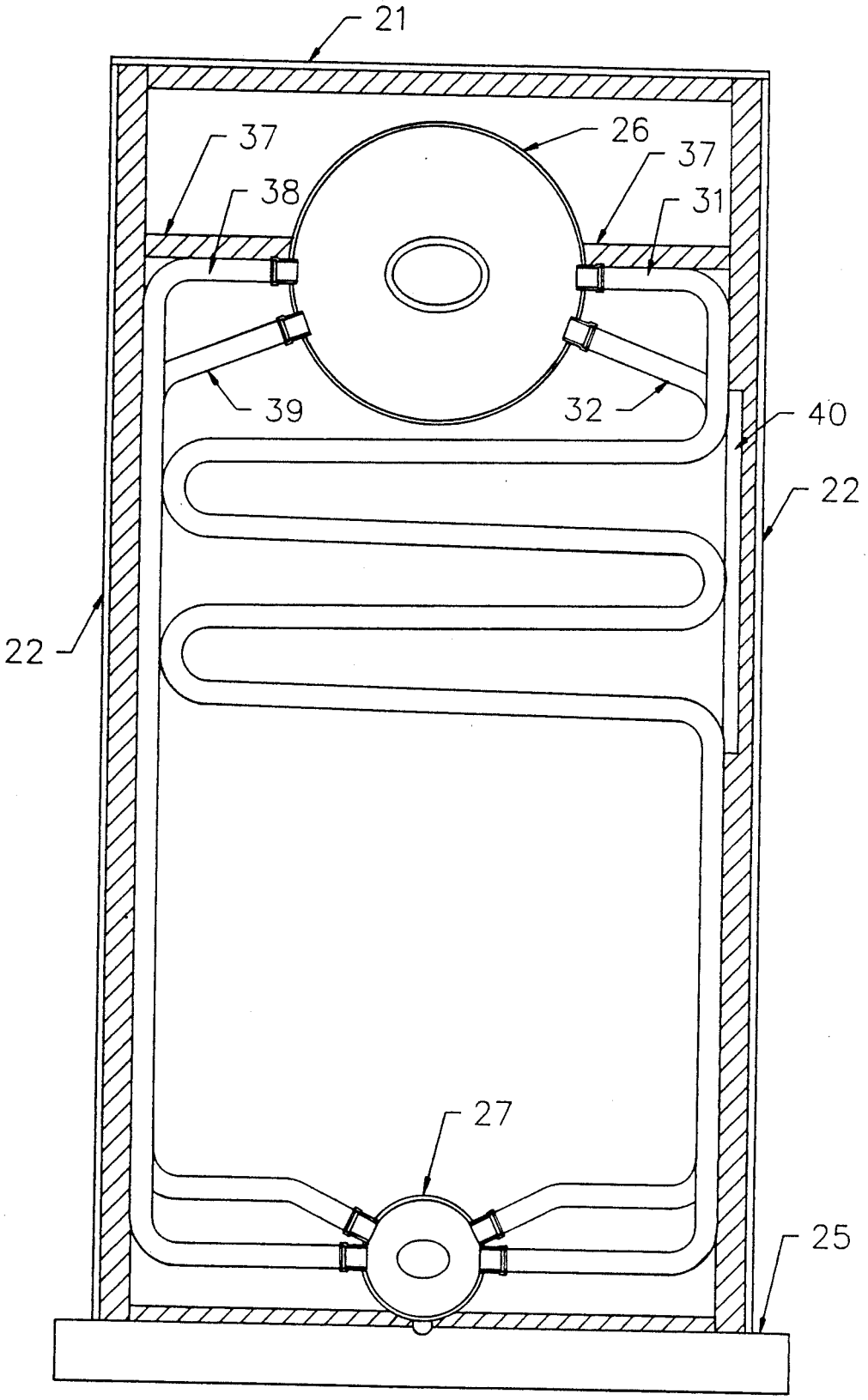
FIG. 4 is section at B—B of FIG. 2 and FIG. 11 showing the serpentine and straight tubes and the manifolds.
Figure 11:
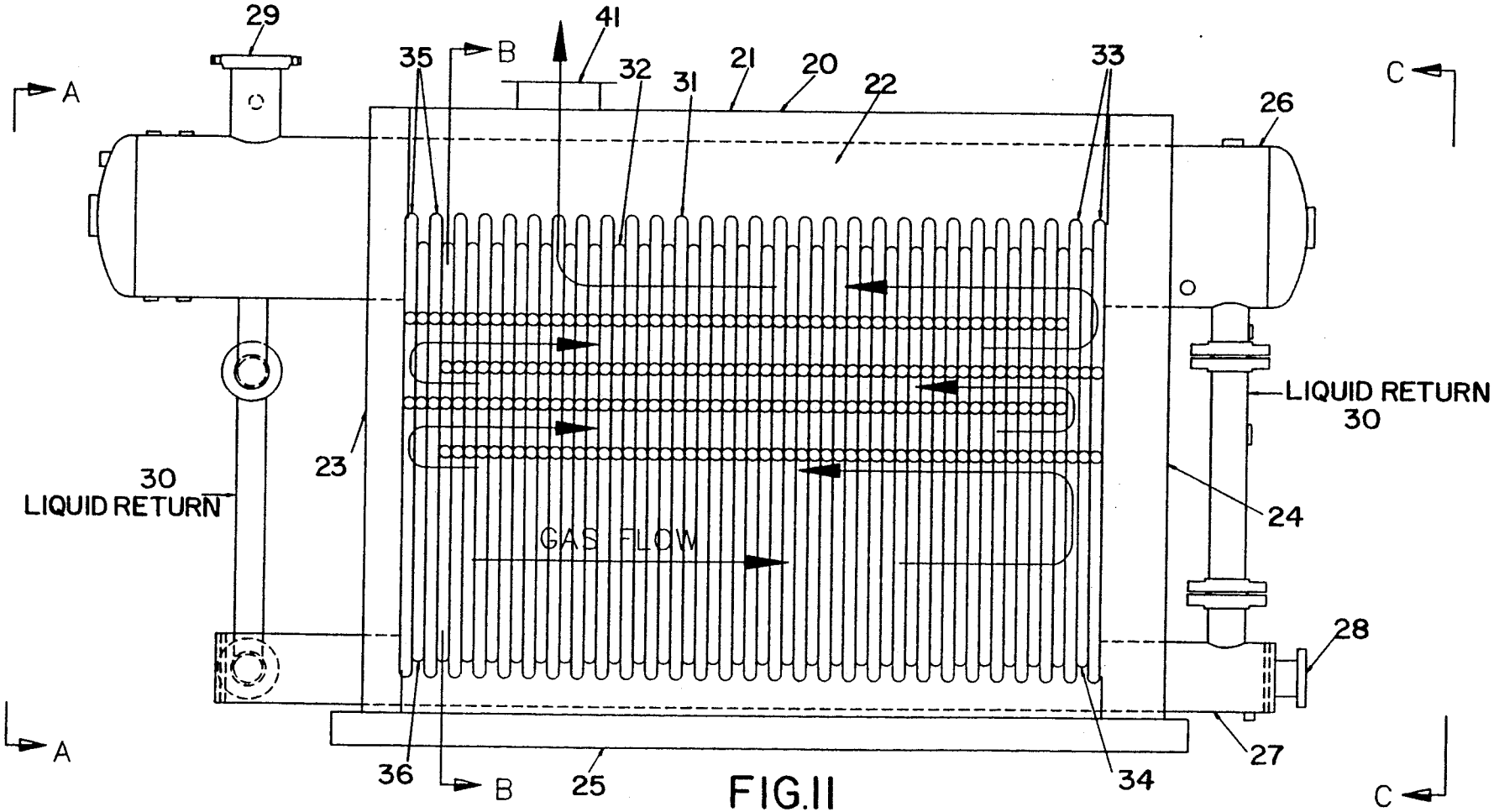
FIG. 11 is a right side view of the boiler and housing with two gas passes in the furnace or lowermost passage and the gas exit at the front of the boiler.

FIG. 4 is a section common to all boilers of FIG. 2 and 11 and shows top wall 21, side walls 22 and base 25. It shows the formation of gas passages with serpentine tubes 31 and 32 the straight tubes 38 and 39 and a gas passage closing plate 40. It shows the upper manifold 26 and the lower manifold 27 and it illustrates the tube connections to the manifolds.

Figure 5:
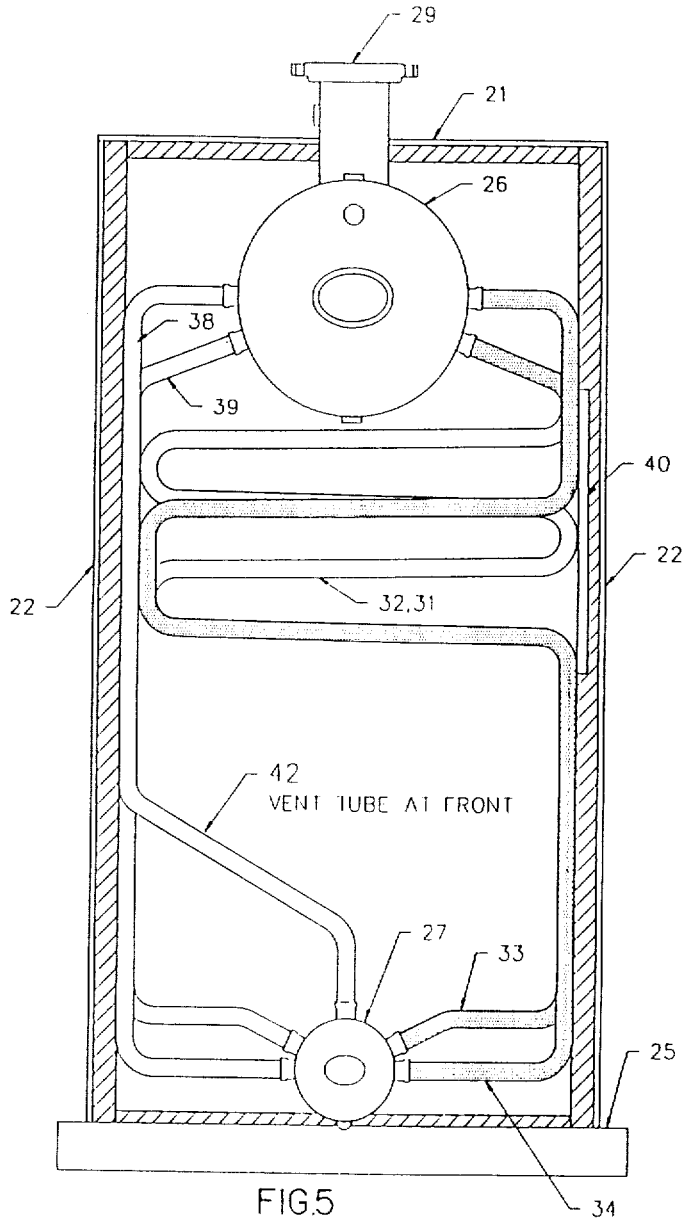
FIG. 5 is a front view of FIG. 2 showing the differently bent tubes that form the access opening to permit the gases to flow from one gas passage to the next.

FIG. 5 is a front view of FIG. 2 showing top wall 21, side walls 22, and base 25. It shows the serpentine tubes that are bent differ ently to form the access openings that allow the gases to flow from one gas passage to the next. 33 and 34, the serpentine tubes 31 and 32 are shown, straight tubes 38 and 39, vent tube 42, upper manifold 26, lower manifold 27, connection for withdrawing liquid or steam from the upper manifold 29 and removable gas passage closing plate 40.

Figure 6:
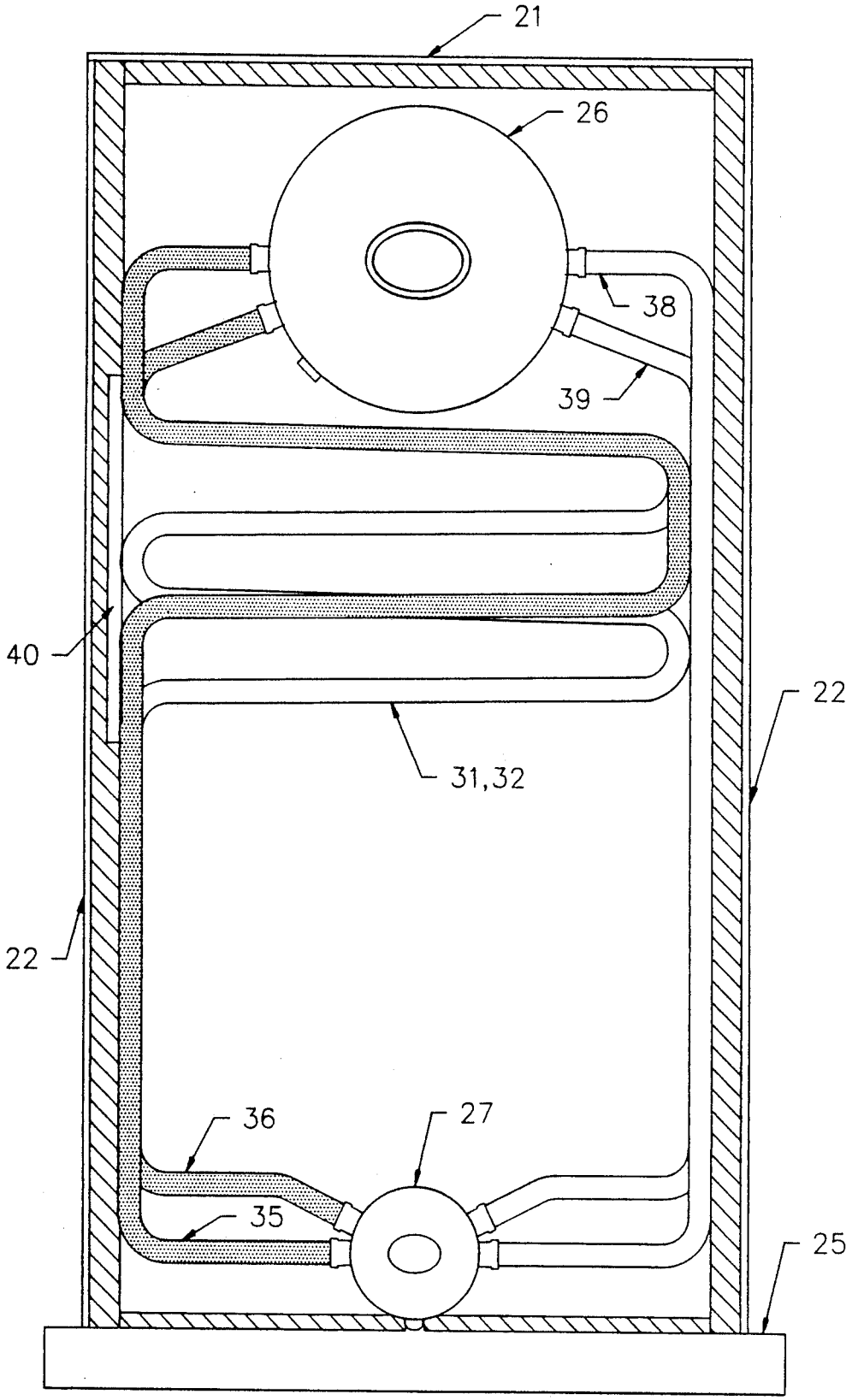
FIG. 6 is a rear view of FIG. 2 showing the differently bent tubes that form the access opening to permit the gases to flow from one gas passage to the next.

FIG. 6 is a rear view of FIG. 2 showing top wall 21, side walls 22, and base 25. It shows the serpentine tubes that are bent differently to form the access openings that allow the gases to flow from one gas passage to the next. 35 and 36, serpentine tubes 31 and 32 are shown, straight tubes 38 and 39, vent tube 42, upper manifold 26, lower manifold 27, and removable gas passage closing plate 40.

Figure 7:
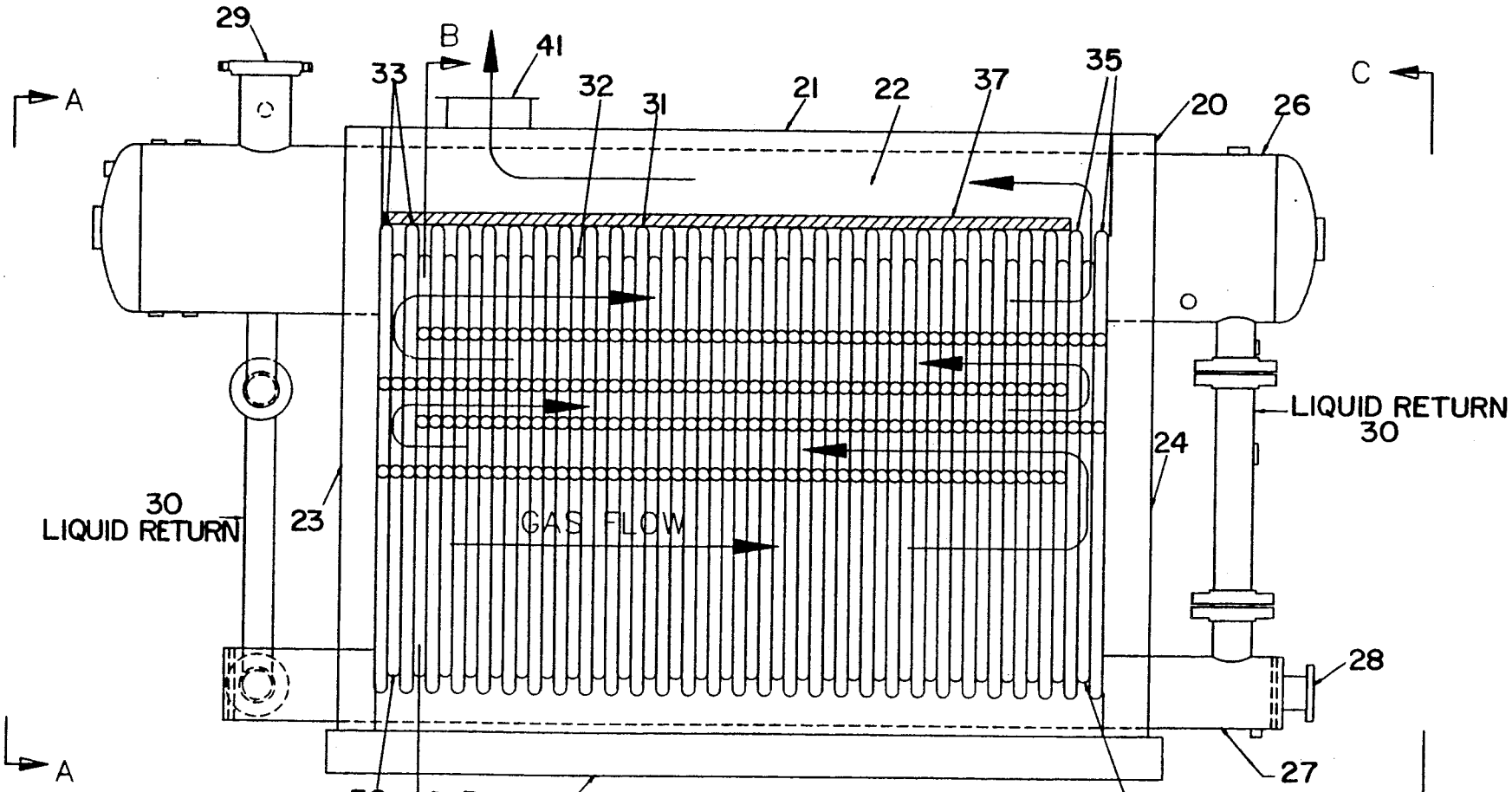
FIG. 7 is a right side view of the boiler and housing with a single gas pass through the furnace or lowermost passage, with an insulating board redirecting the gas to exit at the front of the boiler.

FIG. 7 shows a housing 20 having a top wall 21, two side walls 22, a front wall 23, a rear wall 24, a base 25 and a gas outlet 41 at the front. An upper manifold 26, a lower manifold 27, a connection 28 for introducing liquid into the lower manifold, a connection 29 for withdrawing heated liquid or steam from the upper manifold, liquid returns 30 connecting the bottom of the upper manifold to the top of the lower manifold. Serpentine tubes 31 and 32 which form the gas passages, and serpentine tubes 33 and 34 which form the access openings from gas passage to gas passage at the front and serpentine tubes 35 and 36 which form the access openings from gas passage to gas passage at the rear, and an insulating board 37 that redirects the gases to the front of the boiler.

Figure 8:
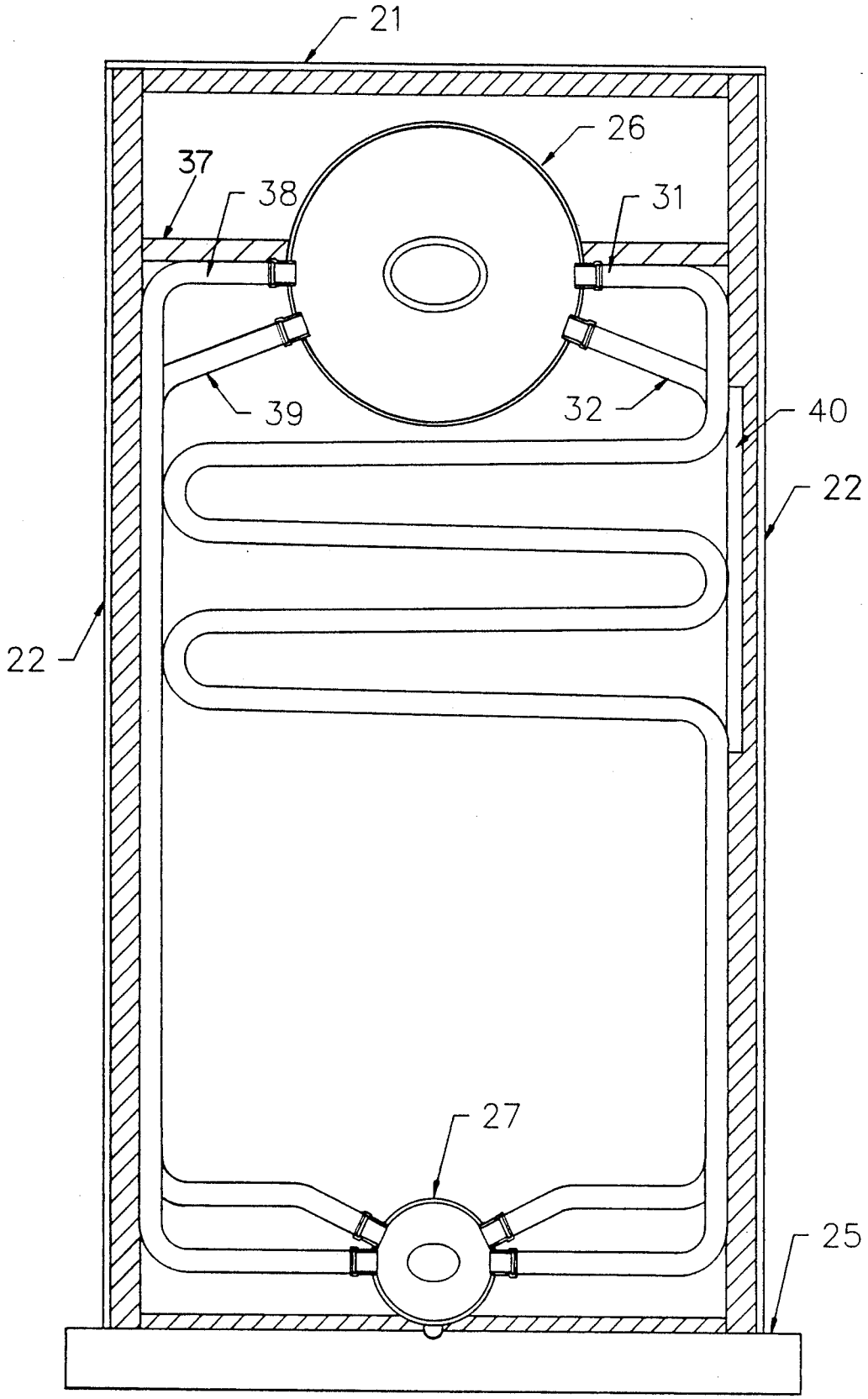
FIG. 8 is a section at B—B of FIG. 7 and FIG. 14 showing the serpentine and straight tubes, the manifolds and the insulating board which redirects the gases.
Figure 14:
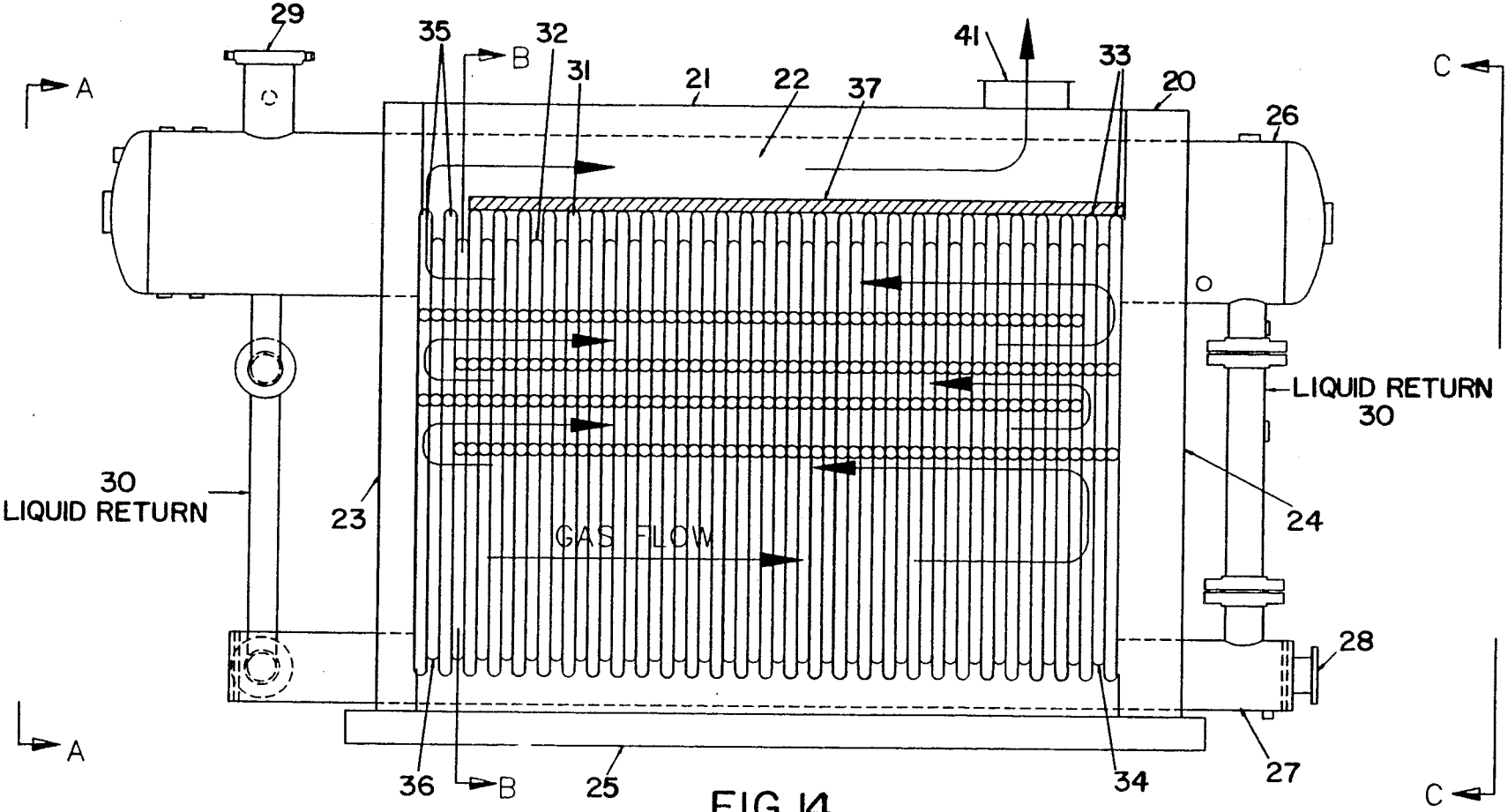
FIG. 14 is a right side view of the boiler and housing with two gas passes in the furnace or lowermost passage, with the insulating board redirecting the gas to exit at the rear of the boiler.

FIG. 8 is a section common to the boilers of FIG. 7 and 14, with top wall 21, side walls 22 and base 25. It shows the formation of gas passages with serpentine tubes 31 and 32, the straight tubes 38 and 39 and the gas passage closing plate 40. It shows the upper manifold 26 and the lower manifold 27, the insulating board 37 that redirects the gases, and it illustrates the tube connections to the manifolds.

Figure 9:
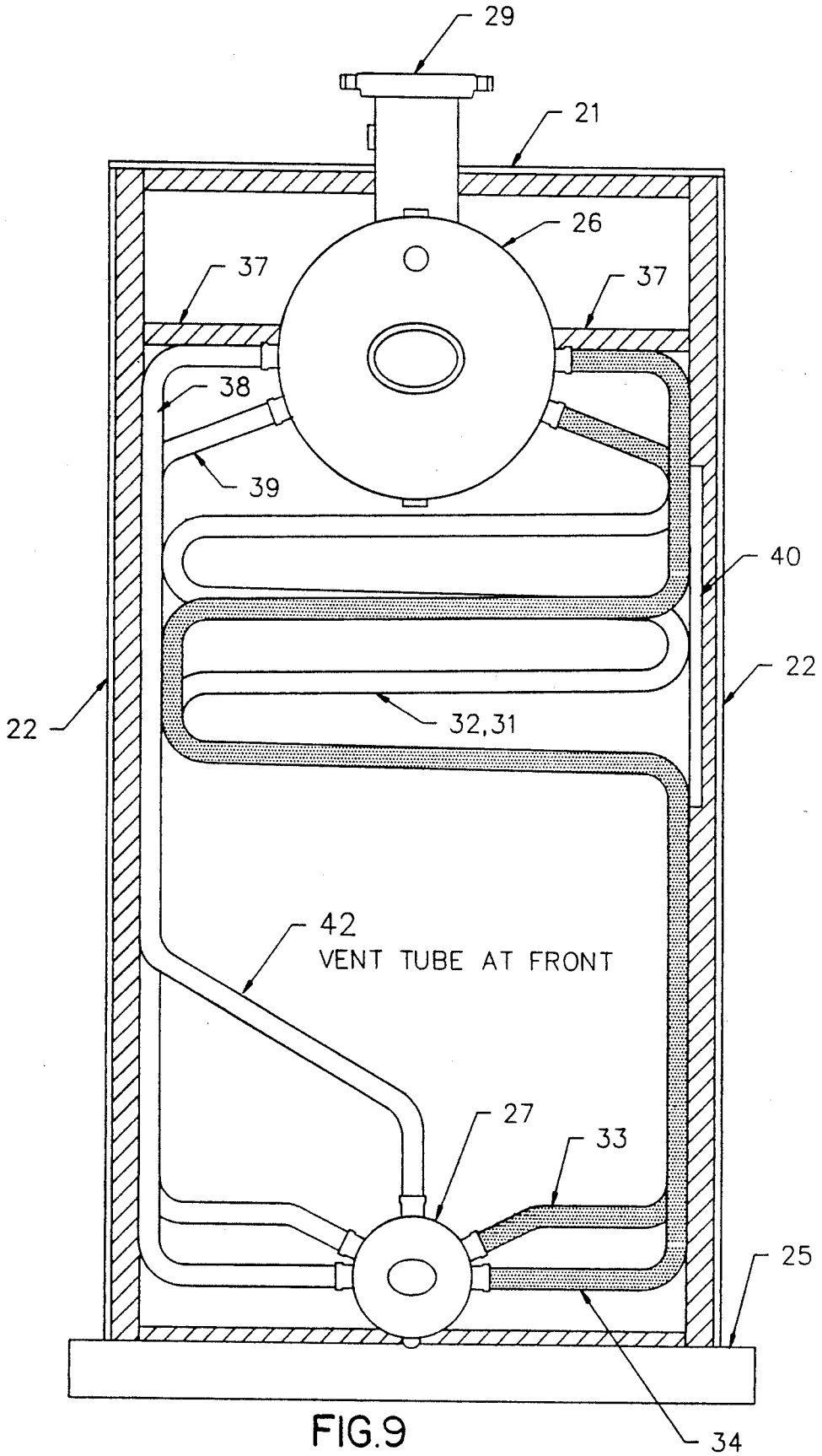
FIG. 9 is a front view of FIG. 7 showing the differently bent tubes that form the access opening to permit the gases to flow from one gas passage to the next with the insulating board which redirects the gases.

FIG. 9 is a front view of FIG. 7 showing top wall 21, side walls 22, and base 25. It shows the serpentine tubes that are bent differently to form the access openings that allow the gases to flow from one gas passage to the next. 33 and 34, the serpentine tubes 31 and 32 are shown, straight tubes 38 and 39, vent tube 42, upper manifold 26, lower manifold 27, connection 29 for withdrawing liquid or steam from the upper manifold, removable gas passage closing plate 40, and the insulating board 37 that redirects the gases.

Figure 10:
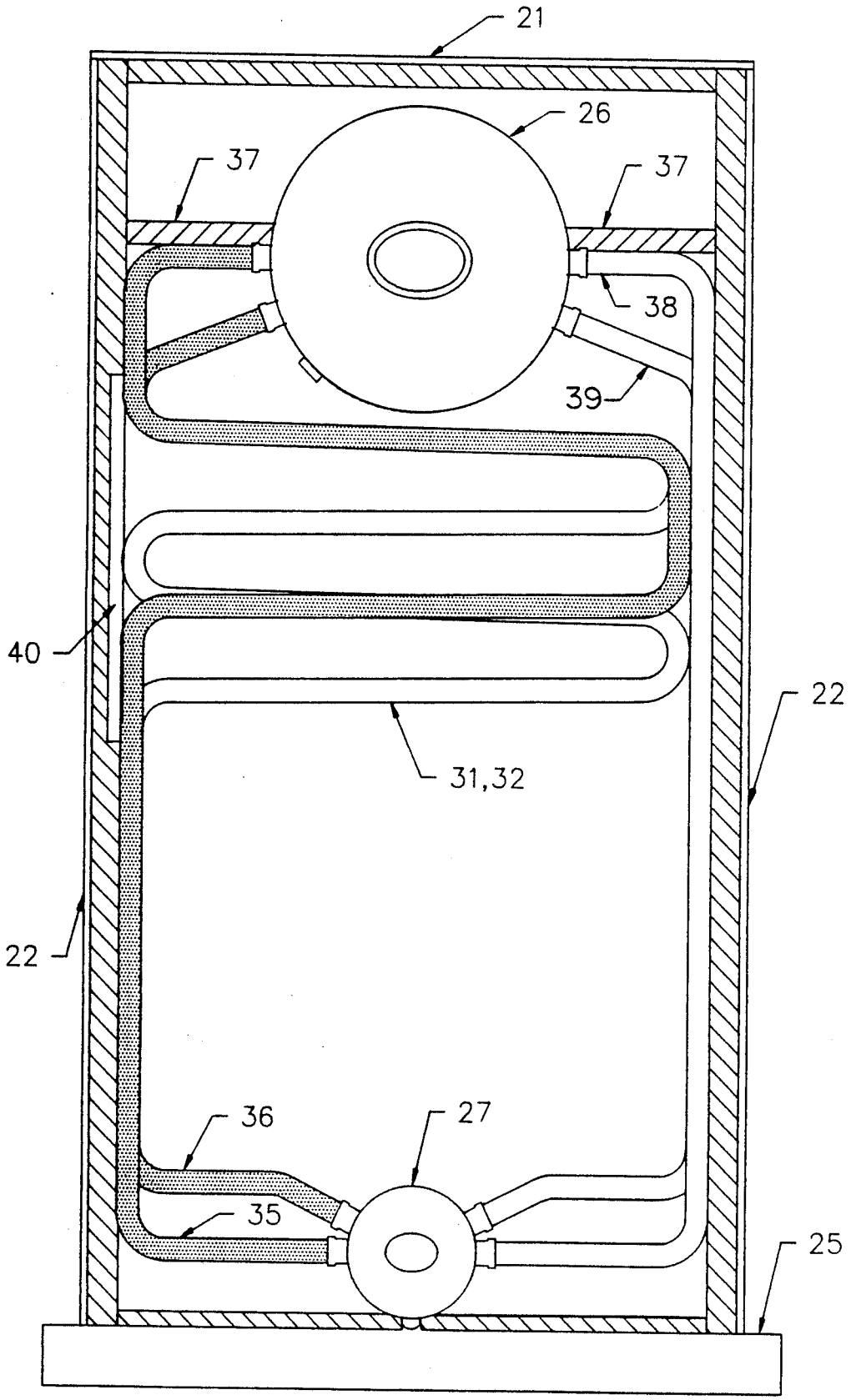
FIG. 10 is a rear view of FIG. 7 showing the differently bent tubes that form the access opening to permit the gases to flow from one gas passage to the next with the insulating board which redirects the gases.

FIG. 10 is a rear view of FIG. 7 showing the housing 20 with a top wall 21, side walls 22, base 25. It shows the serpentine tubes that are bent differently to form the access openings that allow the gases to flow from one gas passage to the next. 35 and 36, serpentine tubes 31 and 32 are shown, straight tubes 38 and 39, vent tube 42, upper manifold 26, lower manifold 27, removable gas passage closing plate 40 and the insulating board 37 that redirects the gases.

FIG. 11 shows a top wall 21, two side wall 22, a front wall 23, a rear wall 24 a base 25 and a gas 41 outlet at the front. An upper manifold 26, a lower manifold 27, a connection for introducing liquid into the lower manifold 28, a connection for withdrawing heated liquid or steam from the upper manifold 29, liquid returns connecting the bottom of the upper manifold to the top of the lower manifold 30. Serpentine tubes 31 and 32 which form the gas passages, and serpentine tubes 33 and 34 which form the access openings from gas passage to gas passage at the front, and serpentine tubes 35 and 36 which form the access openings from gas passage to gas passage at the rear 35 and 36.

Figure 12:
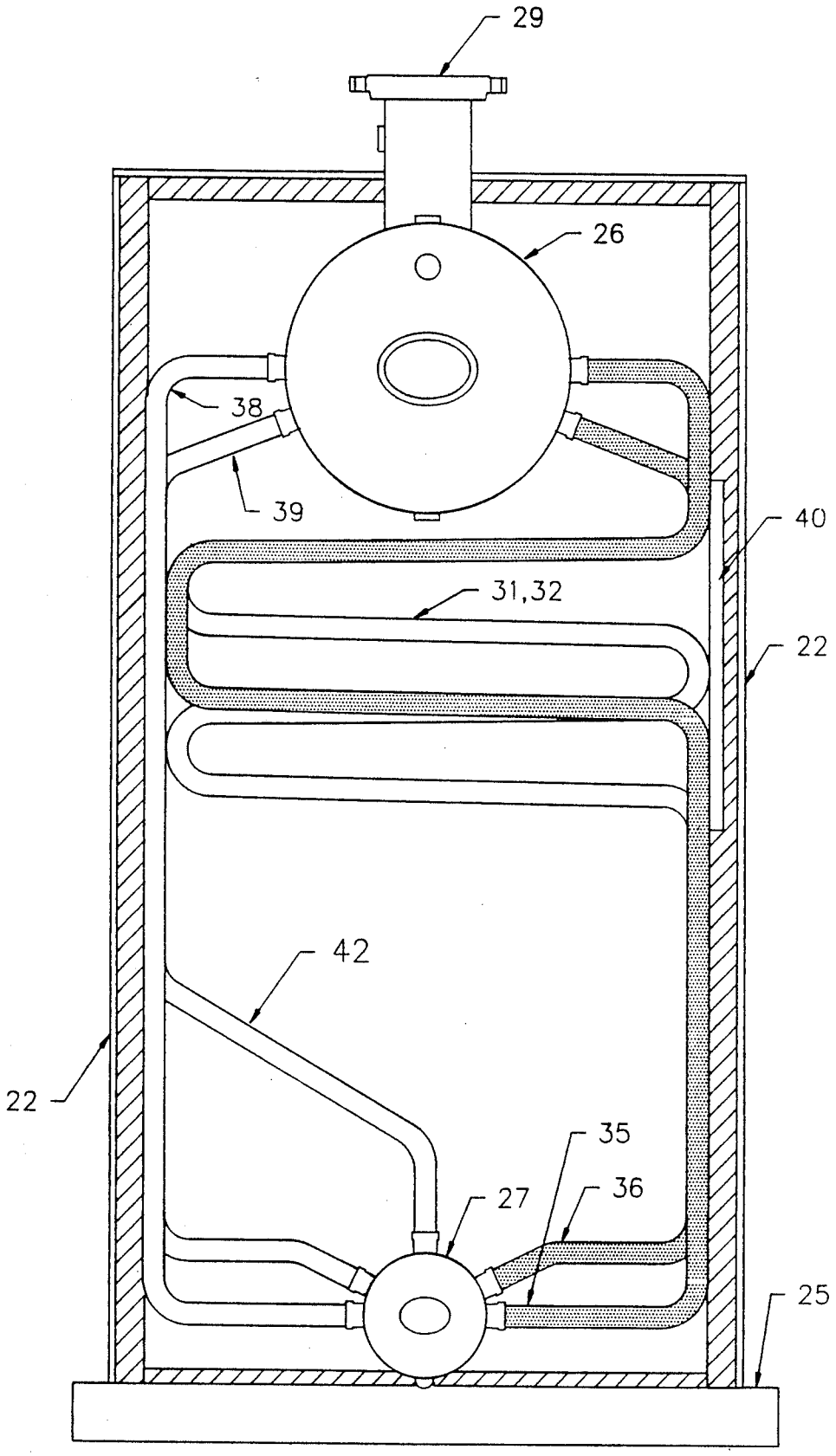
FIG. 12 is a front view of FIG. 11 showing the differently bent tubes that form the access opening to permit the gases to flow from one gas passage to the next.
Figure 13:
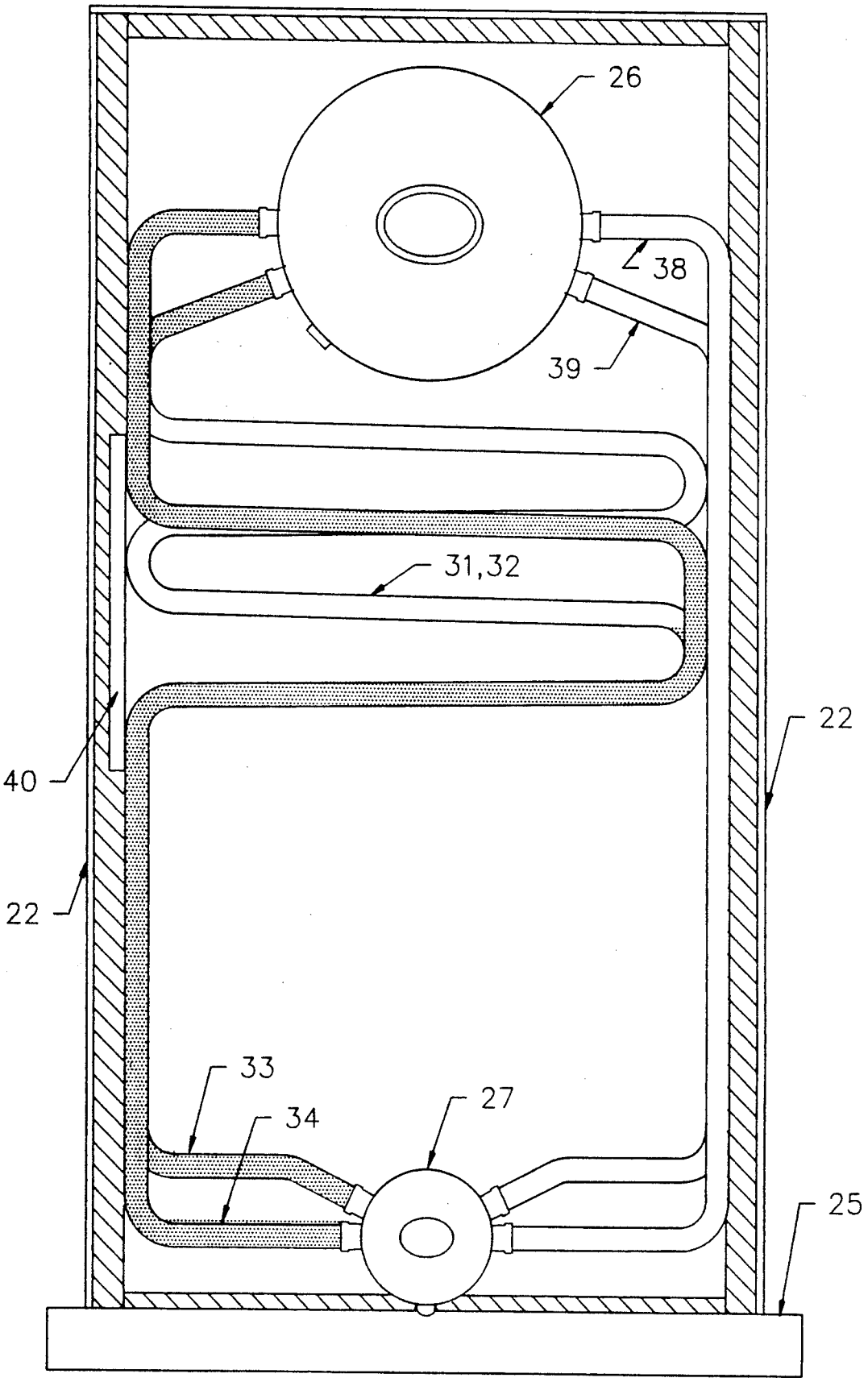

FIG. 12 is a front view of FIG. 11 showing a top wall 21, side walls 22, and base 25. It shows the serpentine tubes 33 and 34 that are bent differently to form the access openings that allow the gases to flow from one gas passage to the next, the serpentine tubes 31 and 32 and straight tubes 38 and 39, vent tube 42 and upper manifold 26, lower manifold 27, connection 29 for withdrawing liquid or steam from the upper manifold and removable gas passage closing plate 40.

Figure 13:
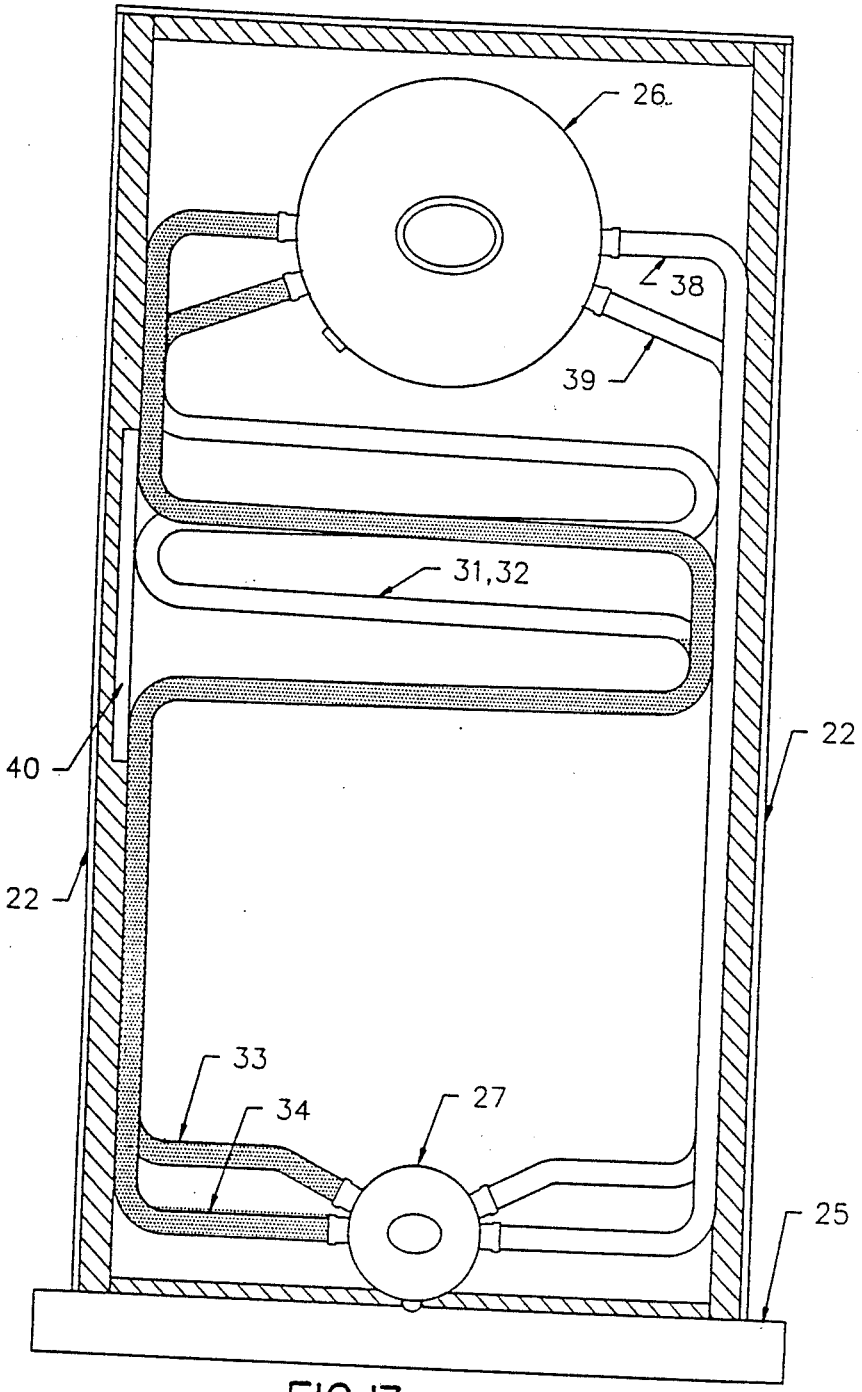
FIG. 13 is a rear view of FIG. 11 showing the differently bent tubes that form the access opening to permit the gases to flow from one gas passage to the next.

FIG. 13 is a rear view of FIG. 11 showing the top wall 21, side walls 22, and base 25. It shows the serpentine tubes 35 and 36 that are bent differently to form the access openings that allow the gases to flow from one gas passage to the next, serpentine tubes 31 and 32, straight tubes 38 and 39, vent tube 42, upper manifold 26, lower manifold 27, and removable gas passage closing plate 40.

FIG. 14 shows a top wall 21, two side walls 22, a front wall 23, a rear wall 24 a base 25, a gas outlet 41 at the rear, an upper manifold 26, a lower manifold 27, a connection 28 for introducing liquid into the lower manifold, a connection 29 for withdrawing heated liquid or steam from the upper manifold, liquid returns 30 connecting the bottom of the upper manifold to the top of the lower manifold, serpentine tubes 31 and 32 which form the gas passages, serpentine tubes 33 and 34 which form the access openings from gas passage to gas passage at the front, serpentine tubes 35 and 36 which form the access openings from gas passage to gas passage at the rear and the insulating board 37 that redirects the gases to the rear of the boiler.

Figure 15:
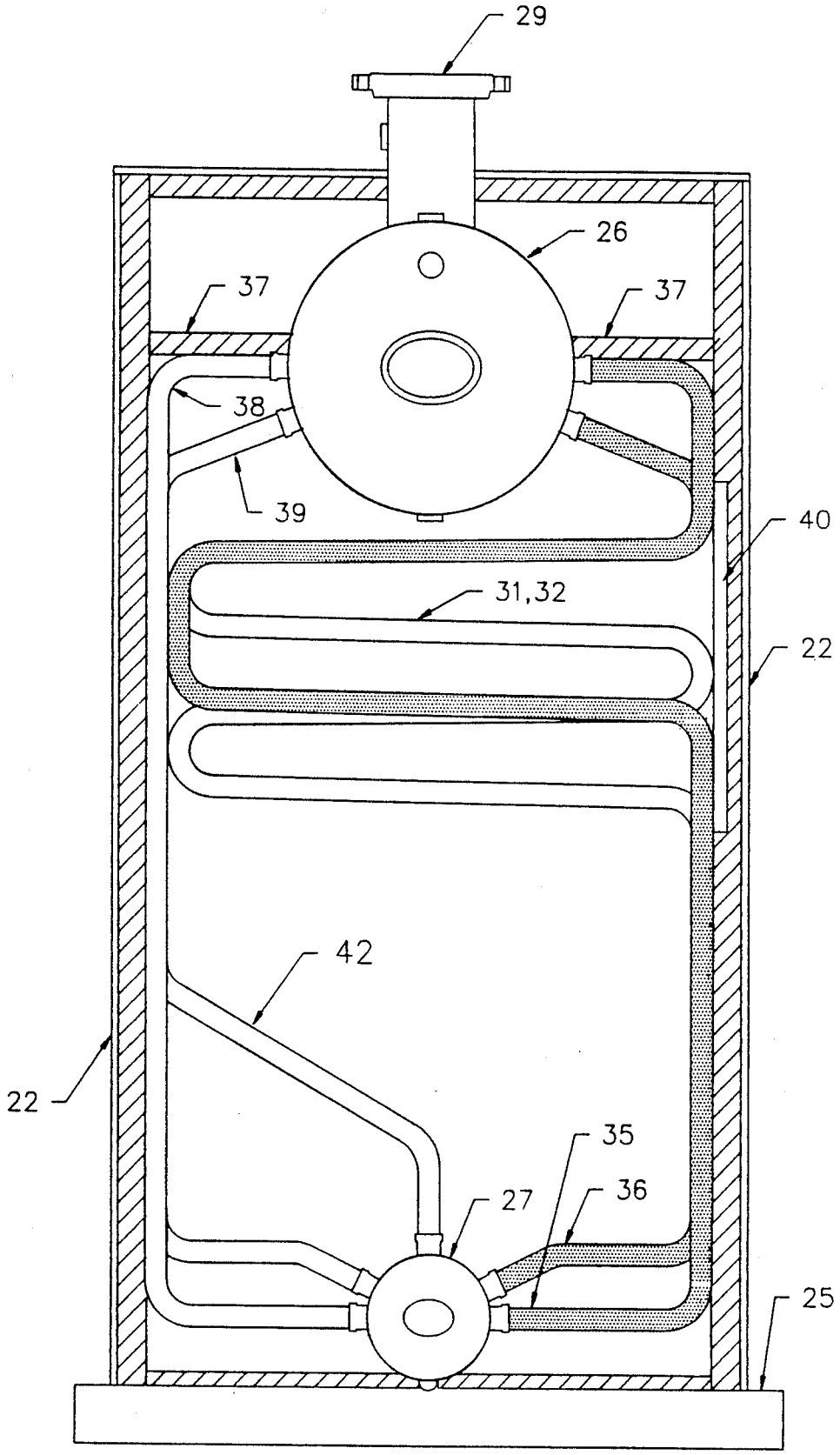
FIG. 15 is a front view of FIG. 14 showing the differently bent tubes that form the access opening to permit the gases to flow from one gas passage to the next with the insulating board which redirects the gases.

FIG. 15 is a front view of FIG. 14 showing the top wall 21, side walls 22, base 25, serpentine tubes 33 and 34 which are bent differently to form the access openings that allow the gases to flow from one gas passage to the next, serpentine tubes 31 and 32, straight tubes 38 and 39, vent tube 42, upper manifold 26, lower manifold 27, connection 29 for withdrawing liquid or steam from the upper manifold, removable gas passage closing plate 40, and the insulating board 37 that redirects the gases.

Figure 16:
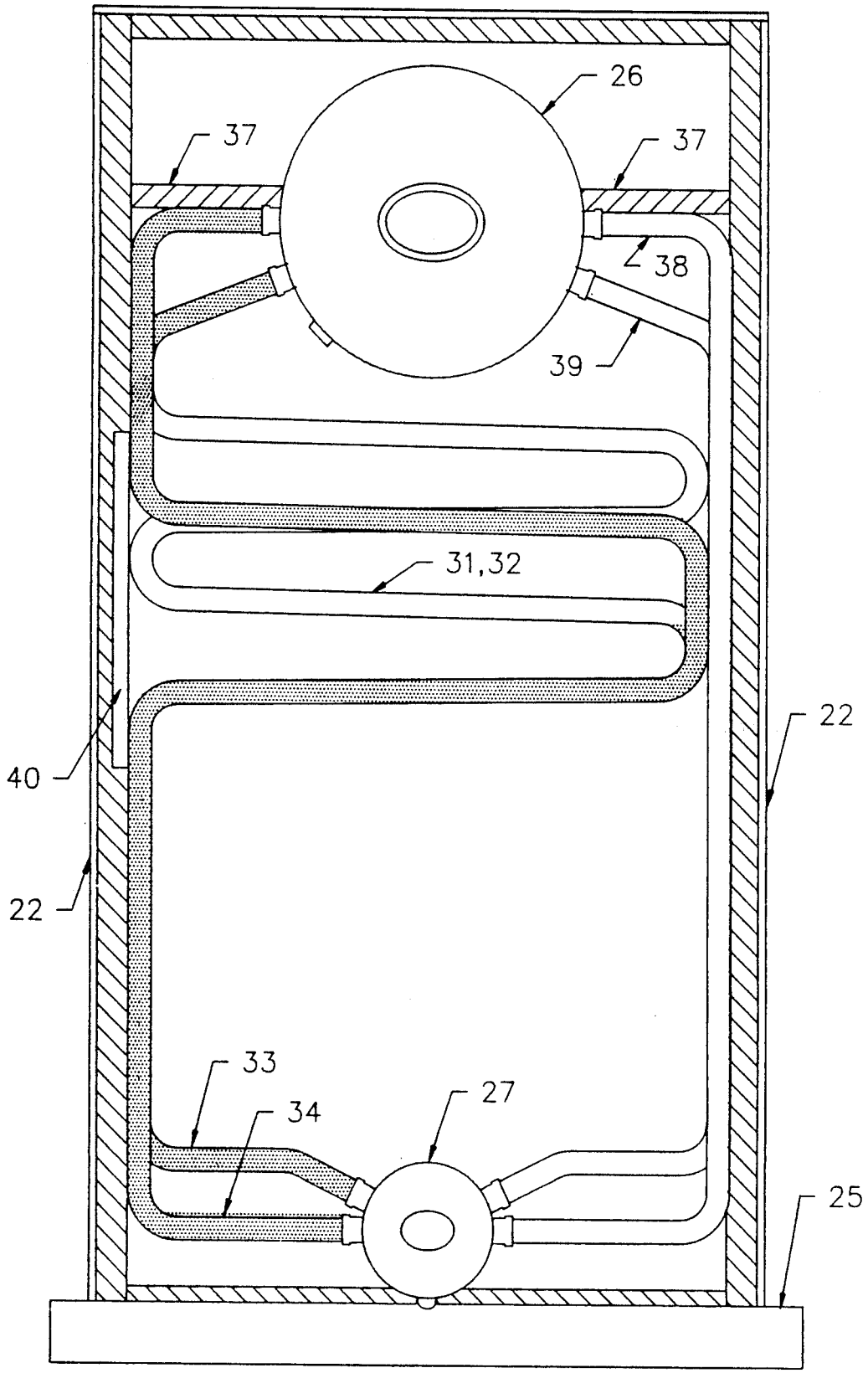
FIG. 16 is a rear view of FIG. 14 showing the differently bent tubes that form the access opening to permit the gases to flow from one gas passage to the next with the insulating board which redirects the gases.

FIG. 16 is a rear view of FIG. 14 showing the top wall 21, side walls 22, base 25, serpentine tubes 35 and 36 which are bent differently to form the access openings that allow the gases to flow from one gas passage to the next, serpentine tubes 31 and 32, straight tubes 38 and 39, vent tube 42, upper manifold 26, lower manifold 27, removable gas passage closing plate 40, and the insulating board 37 that redirects the gases.

Figure 17:
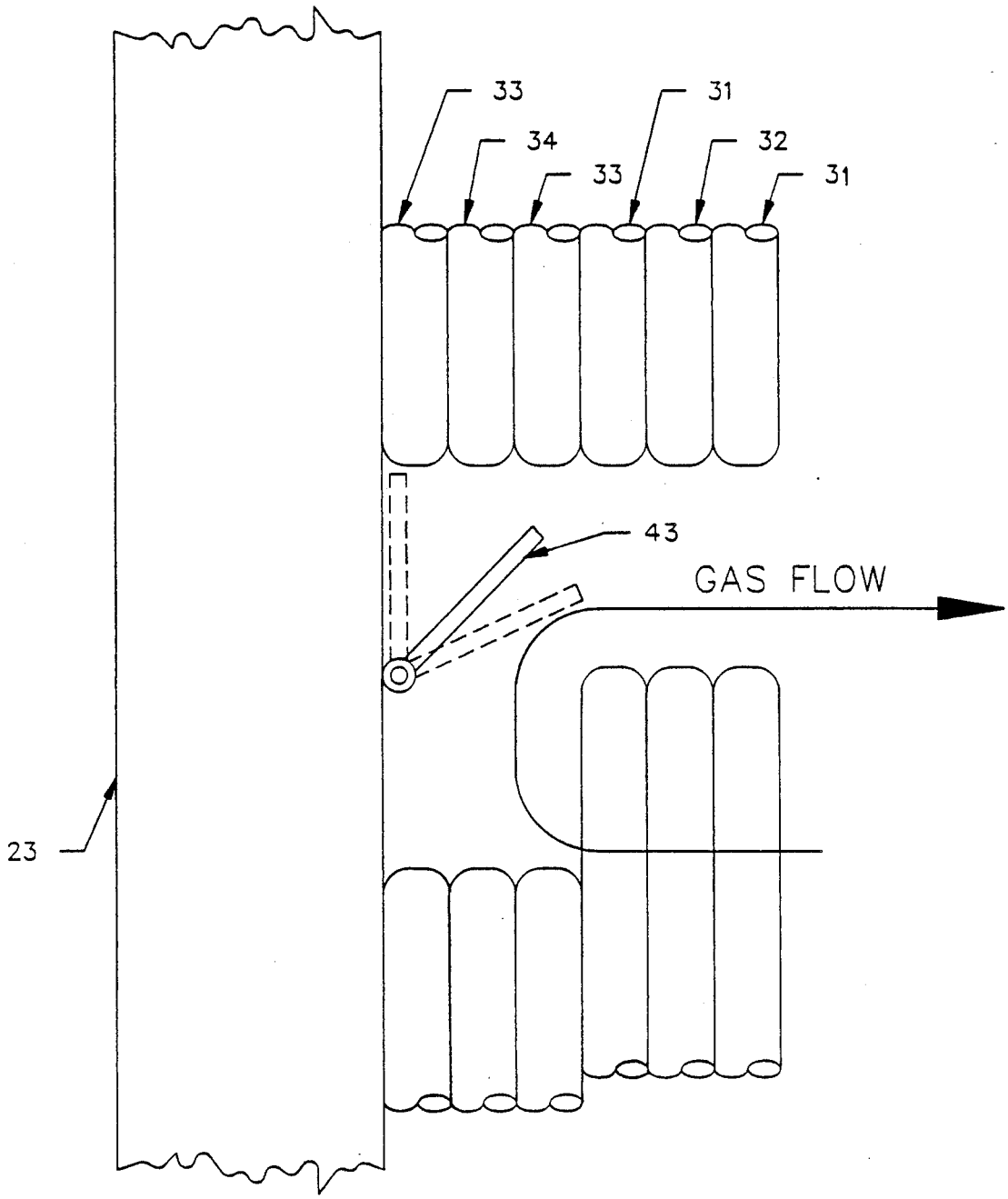
FIG. 17 is a detail of the furnace control damper.

FIG. 17 is a detail of the damper at the access openings between the gas passages and shows a housing front wall 23, tubes 31, 32, 33 and 34 and damper assembly 43.

Figure 18:
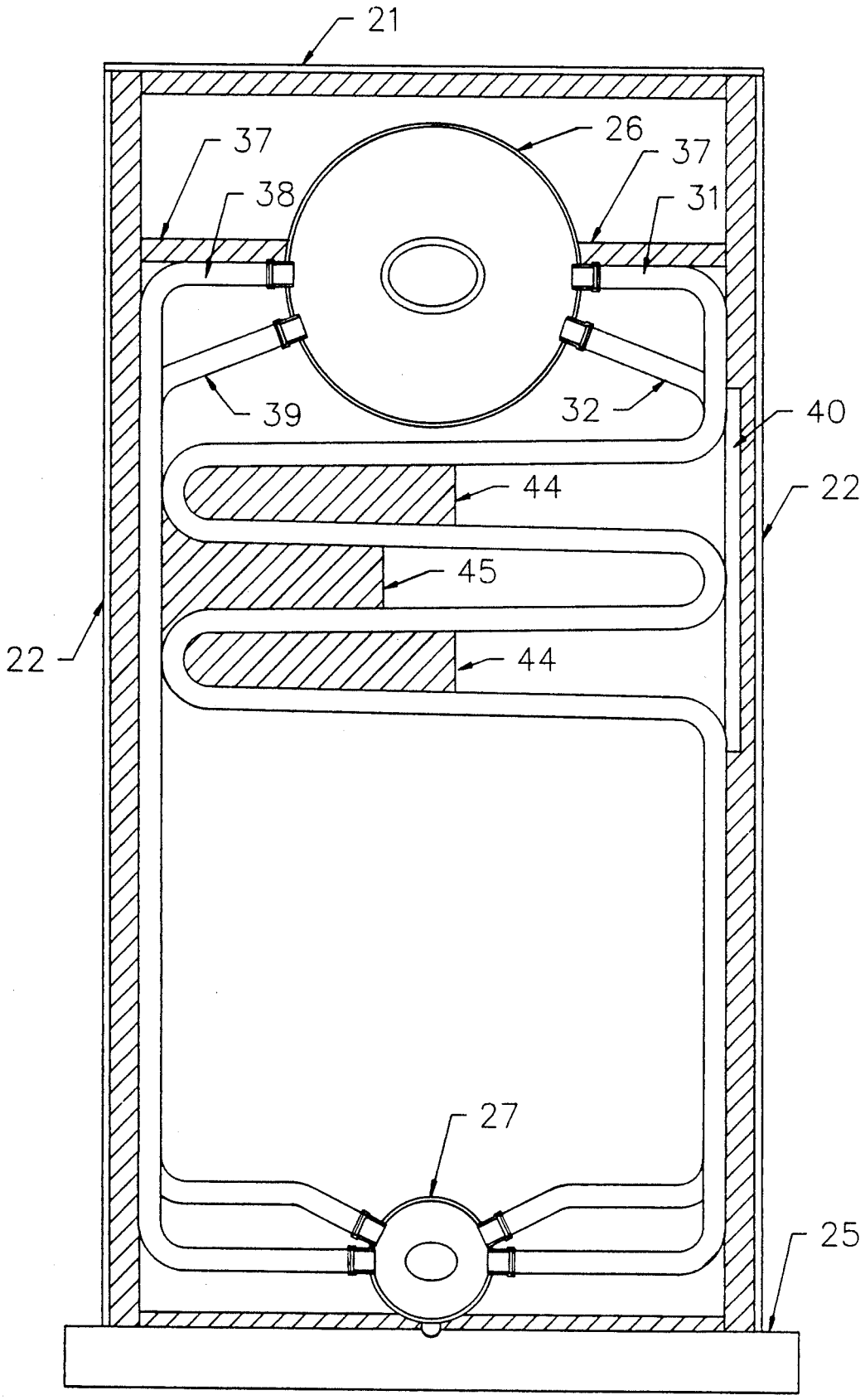
FIG. 18 is a section through the boiler showing optional baffles in the gas passages to elongate the gaseous flow path.

FIG. 18 is a section common to all boilers of the invention and shows top wall 21, side walls 22 and base 25. It shows the formation of gas passages with serpentine tubes 31 and 32 the straight tubes 38 and 39 and a gas passage closing plate 40. It shows the upper manifold 26 and the lower manifold 27, optional baffles 44 and 45 and it illustrates the tube connections to the manifolds.

Figure 19:
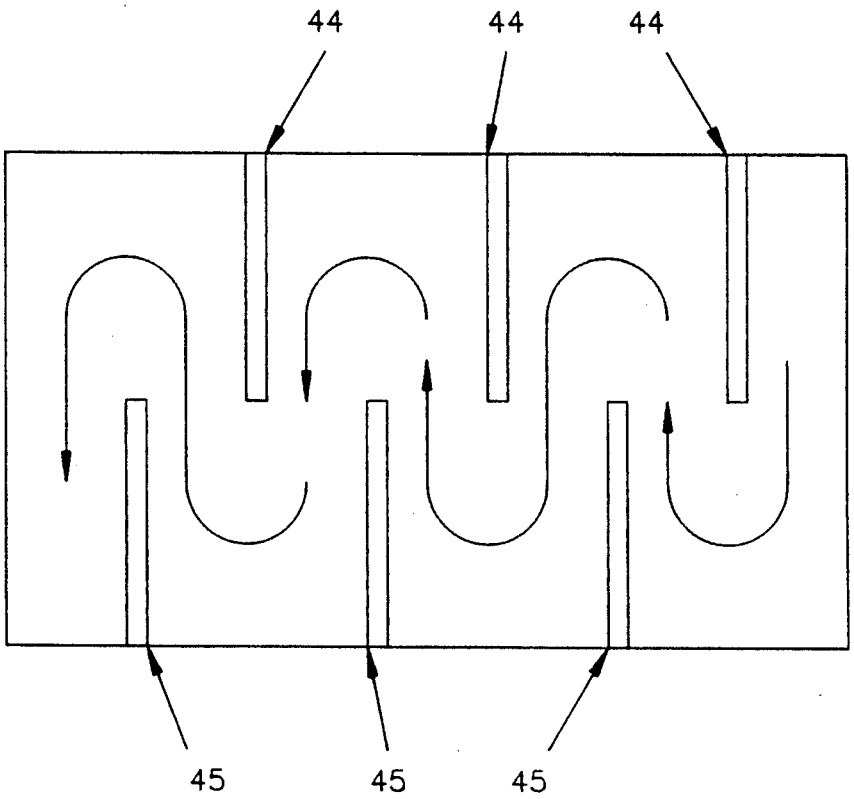
FIG. 19 is a top plan view of the gas flow across one of the gas passages showing the optional baffle.

FIG. 19 is a top plan view of the gas flow across one of the gas passages showing the optional baffle.

Figure 20:
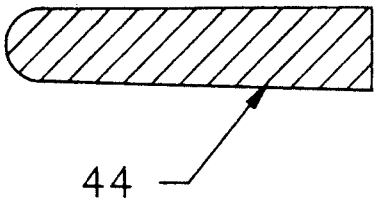
FIG. 20 is a detail of the optional baffle.

FIG. 20 is a detail of optional baffle 45.

Figure 21:
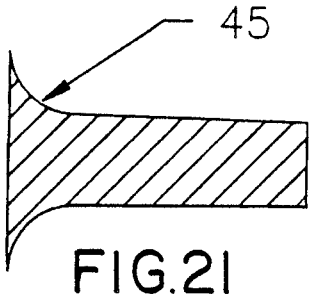
FIG. 21 is a detail of the optional baffle.

FIG. 21 is a detail of optional baffle 46.

The novel boiler offers advantages with regard to nitrogen oxides (NOX) discharges as well. The NOX generation can be held to a minimum if combustion is under steady load and ideal conditions are established. However, where the load fluctuates there is a serious problem. In accordance with the present invention the radiation section, i.e. the burner, is controlled independently of the convection section, i.e. the heat exchanger. Specifically, if less steam is required so less fuel is burned, it is merely necessary to synchronize a motorized damper at the furnace to gas passage access opening with the burner firing rate control so that as the firing rate reduces the damper will close and as the firing rate increases the damper will open, so maintaining the furnace chamber at a constant pressure.

The tubes, drums and manifolds may be formed of conventional boiler materials such as iron, steel, etc., and the boiler surfaces may be lined with refractory material, as desired.

The boiler shown in the drawings has four chambers above the combustion chamber but by appropriate bending of the tubes the number could be one to ten or more.

The number of tubes can also be varied but one suitable installation has the following parameters:

(1) Upper manifold—20" dia × 162"
(2) Lower Manifold—12" dia × 152"
(3) Tube diameters—1½" inches
(4) Number of tubes per side—61
(5) Total number of passages—5.

Certain advantages of the system have already been noted but there are many more. Specifically, the novel construction has the following advantages:

The ability to independently control the combustion chamber pressures at all firing rates makes the burning of any fuel more efficient and easier.

The boiler can be efficiently fired with gas, oil or coal by fluidized bed, underfeed and spreader stroker, pulverized burner, wood or any solid combustible fuel or even municipal waste.

The boiler gas passages are easily cleaned either manually or automatically.

The boiler is suitable for exhaust gas utilization.

The boiler meets the requirements of the ASME steam boiler construction code, Section 1, for low and high pressure steam, low and high temperature hot water, hot mineral oils and black liquor. The entrance of tubes into the manifolds allows large ligaments between the tube holes. This results in the boiler drums being as little as only 30 percent of the thickness that is required in traditional boilers. This also allows the tubes to be attached to the drums by a drive morse taper rather than expanding the tube ends into the manifolds, which reduces labor costs in production and/or field assembly.

The boiler does not require external draft controls of any kind.

The boiler pressure vessel forms a perfect rectangular cube with water cooled sides and thus eliminates the need for expensive refractories and insulation.

The boiler tubes provide free expansion and contraction in all areas.

It will be appreciated that the instant specification and examples are set forth by way of illustration and not a limitation and that various modifications and changes may be made without departing from the spirit and scope of the present invention.

We claim:

1. A boiler comprising a housing having a top provided with a gas outlet, bottom, left and right sides and a front and back, the housing containing an upper manifold and a lower manifold substantially parallel to the top, bottom and side walls, first and second sets of tubes each comprising a plurality of tubes, one set joining the upper manifold to the lower manifold on the left and the other set joining the upper manifold to the lower manifold on the right, the tubes of the first set rising from the lower manifold upwardly along their side wall, crossing the housing to the opposite side wall, re-crossing the housing to their respective side wall, rising therealong and eventually joining the upper manifold so as to form a plurality of superposed passages, the tubes of the second set rising from the lower manifold upwardly along their side wall and then joining the upper manifold, individual tubes of the first set being differently bent so as to form access openings from each passage to the passages above and below, the openings from passage to passage being offset so as to require a gas flowing through said passages to traverse one passage from front to back and the next passage from back to front, means for introducing liquid into one of the manifolds and for withdrawing the liquid from the other manifold and means for introducing a hot gas into the lowermost of the superposed passage, the hot gas rising successively through the passages which it successively and alternatively traverses from front to back and then from back to front until it exits from the uppermost passage through the gas outlet in the top, liquid flowing through the manifolds and tubes being heated by the hot gas.

2. A boiler according to claim 1, wherein the tubes of each set are in substantial contact with one another so as substantially to prevent passage of hot gas therebetween.

3. A boiler according to claim 1, including a plate at that side of the housing remote from the second set of tubes and laterally closing off the superposed passages.

4. A boiler according to claim 1, including an insulating board atop the tops of the tubes with an opening at one end remote from the gas outlet so that the gas leaving the uppermost passage defined by the tubes must traverse the housing to arrive at the gas outlet.

5. A boiler according to claim 4, wherein the gas outlet and the means for introducing hot gas into the lowermost of the superposed passage are at opposite ends of the housing.

6. A boiler according to claim 4, wherein the gas outlet and the means for introducing hot gas into the lowermost of the superposed passage are at the same end of the housing.

7. A boiler according to claim 6, wherein there is an odd number of superposed passages.

8. A boiler according to claim 6, wherein there is an even number of superposed passages.

* * * * *

UNITED STATES PATENT AND TRADEMARK OFFICE

CERTIFICATE OF CORRECTION

PATENT NO. : 4,993,368

DATED : February 19, 1991

INVENTOR(S) : Jones, et. al.

It is certified that error appears in the above-identified patent and that said Letters Patent is hereby corrected as shown below:

Sheet 5 should be deleted to appear as shown on the attached sheet.

Signed and Sealed this

First Day of September, 1992

*Attest:*

DOUGLAS B. COMER

*Attesting Officer*

*Acting Commissioner of Patents and Trademarks*